United States Patent [19]

Hellings et al.

[11] Patent Number: 4,961,022

[45] Date of Patent: Oct. 2, 1990

[54] DISPLAY TUBE INCLUDING A HELICAL FOCUSING LENS WITH A NON-ROTATIONALLY SYMMETRICAL LENS ELEMENT

[75] Inventors: Gerardus J. A. Hellings; Antonius W. F. Van Der Heijden; Erich E. Himmelbauer; Gerardus A. H. M. Vrijssen; Tjerk G. Spanjer; Willem M. Van Alphen; Jeroen Van Engelshoven, all of Eindhoven, Netherlands

[73] Assignee: U.S. Philips Corporation, New York, N.Y.

[21] Appl. No.: 342,413

[22] Filed: Apr. 24, 1989

[30] Foreign Application Priority Data

May 20, 1988 [NL] Netherlands ..... 8801308

[51] Int. Cl.[5] ..... H01J 29/62

[52] U.S. Cl. ..... 313/414; 313/450; 313/458

[58] Field of Search ..... 313/414, 450, 458, 460

[56] References Cited

U.S. PATENT DOCUMENTS 4,211,953 7/1980 Rybalko ..... 313/450

4,857,797 8/1989 Vrijssen et al. ..... 313/450

*Primary Examiner*—Kenneth Wieder

*Attorney, Agent, or Firm*—Robert J. Kraus

[57] ABSTRACT

A display tube comprising an electron gun having a beam-shaping part and a focusing structure. The focusing structure comprises an elongate hollow structure with a high-ohmic resistive layer provided on the inner and/or outer surface and comprises means for forming a non-rotationally symmetrical lens element in the area of the focusing structure. This may be a structure generating an electric multipole (for example, dipole or quadrupole) which may be incorporated particularly in the high-ohmic resistive layer.

8 Claims, 5 Drawing Sheets

DISPLAY TUBE INCLUDING A HELICAL FOCUSING LENS WITH A NON-ROTATIONALLY SYMMETRICAL LENS ELEMENT

BACKGROUND OF THE INVENTION

The invention relates to a display tube having an envelope, comprising a phosphor screen on one side and a neck portion on the other side, and an electron gun positioned in the neck portion and comprising a beam-shaping part for producing an electron beam, and a focusing structure for focusing the produced electron beam on the phosphor screen. When designing electron guns for display tubes, one of the problems of realizing a gun is a small deflection defocusing accompanied by a small spherical aberration. Hitherto it has always been tried to find a solution for the one aspect, while the other aspect was taken for granted.

For example, in U.S. Pat. No. 4,366,419 a color television display tube is described which comprises an electron gun of the in-line type having three individual focusing lenses each comprising a first and a second tubular electrode. The first electrode has means (diametrically facing transversal apertures each co-operating with an auxiliary electrode) for forming a non-rotationally symmetrical (astigmatic) lens element in the region of the first electrode. In this case voltages are applied to the electrodes such that the astigmatism and the power of the focusing lens are simultaneously controlled. In this way the deflection defocusing of the spot is combated, which defocusing is particularly intolerable in high-resolution color television display tubes. A drawback of the construction of the electron gun of the color television display tube described in the U.S. Pat. No. 4,366,419 is, however, that three metal tubular electrode sets have to be accommodated side by side in the neck of the tube so that the diameters of these metal tubular electrode sets are bound to maximum dimension, which means that the spot size as such cannot be very small as a result of spherical aberration, although the deflection defocusing is efficiently combated by providing a non-rotationally symmetrical electrically controlled lens element so that the spot size does not notably increase in the case of deflection.

SUMMARY OF THE INVENTION

It is an object of the invention to provide a display tube having an improved electron gun.

In particular, it is an object of the invention to provide a (color) television display tube having an electron gun in which a small deflection defocusing is accompanied by a small spherical aberration.

According to the invention the display tube of the type described in the opening paragraph is therefore characterized in that the focusing structure comprises an elongate hollow structure having an inner suface and an outer surface and having a high-ohmic layer of resistive material provided on at least one of these surfaces, which layer operates as a voltage divider, and in that electric means are provided to form a non-rotationally symmetrical lens element in the area of the focusing structure.

The invention is based on the recognition that a high-ohmic resistive layer can be provided on a cylindrical surface (of, for example a glass tube) in such a way that equipotential faces (forming an axis lens field) are produced when a voltage is applied across the layer, which faces correspond to the equipotential faces of a set of metal tubular electrodes having a much larger diameter. In other words, the spherical aberration of a color electron gun with three individual focusing structures as described above is considerably smaller—in the case of the same diameter—than the spherical aberration of a conventionl gun with three metal tubular focusing electrodes, more specifically—as will be explained hereinafter—without having to abandon the function of a non-rotationally symmetrical lens element in the area of the focusing structure.

Within the scope of the invention the practical realization of the above-mentioned concept is possible in different ways.

A first embodiment is characterized in that the elongate hollow structure comprises two coaxially arranged structure parts with a high-ohmic layer of resistive material provided on the inner surface, the facing ends of the structure parts each being provided with an apertured metal plate and the scope of the apertures in the metal plates being adapted to provide a non-rotationally symmetrical lens element.

The aperture in the metal plate at the end of the focusing structure part adjoining the beam-shaping part may be formed, for example as a horizontal rectangle and in the facing metal plate may be formed, for example a vertical rectangle for forming a four-pole lens. The astigmatism can be dynamically controlled by applying the correct dynamic voltages to the metal plates.

A non-rotationally symmetrical lens element can easily be realized in this embodiment by "sawing" the hollow structure "into two part" and by providing metal (auxiliary electrode) plates on the facing ends of the partial structures.

A second embodiment is characterized in that a part of the high-ohmic resistive layer of the focusing structure is adapted to form a non-rotationally symmetrical lens element.

This embodiment has the advantage that the non-rotationally symmetrical lens element, like the (rotationally symmetrical) focusing lens, is formed from a high-ohmic resistive layer.

There are a number of alternatives for the design of the resistive layer of the non-rotationally symmetrical lens element. An alternative providing many possibilities is characterized in that a groove pattern, which is continuous or discontinuous and which bisects the layer, is provided in the part of the resistive layer, the pitch of the groove patten varying as function of the azimuth angle to form a desired non-rotationally symmetrical lens element. In this case electric multipoles (dipole, quadrupole, etc.) are generated becouse a non-rotationally symmetrical electric field is generated when applying a voltage difference across the layer.

BRIEF DESCRIPTION OF THE DRAWING

Some embodiments of the display tube according to the invention will be described with reference to the accompanying drawing figures in which.

DESCRIPTION OF THE PREFERRED EMBODIMENTS

Figure 1:
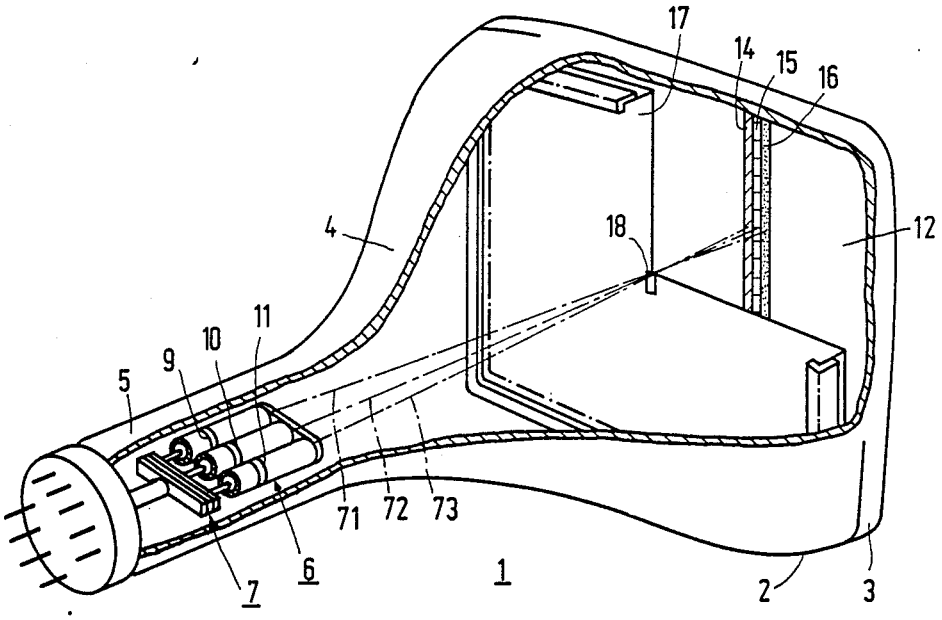
FIG. 1 is a perspective elevational view, partly broken away, of a (color) television display tube comprising an electron gun according to the invention.

FIG. 1 shows a color television display tube 1 having an evacuated envelope 2 with an optically transparent front plate 3, a conical portion 4 extending from wide to narrow and a neck portion 5. A multiple electron gun 6 is coaxially mounted in the neck 5. The multiple electron gun 6 comprises a beam-shaping part 7 which produces three beams 71, 72, 73 in the case shown. Furthermore, the electron gun 6 comprises a focusing portion 8 which comprises three tubular structures 9, 10 and 11 in the case shown with three inner surfaces on which high-ohmic resistive layers are provided in such a pattern. (for example, helical) that three focusing fields are generated upon energization. With the aid of a deflection unit (not shown) arranged on the transition between the neck and the cone the electron beams 71, 72, 73, are moved across a luminescent screen 12 which comprises phosphor elements 14, 15, 16 luminescing in different colors. A color selection electrode 17 having a large number of apertures 18 is disposed at a small distance from the luminescent screen to cause the electron beams 71, 72, 73 to impinge exclusively on their associated phosphors.

The focusing structures 9, 10, 11 are parallel arranged in the case shown and their resistive layer patterns are designed in such a way that, when connected to a voltage source, potential distributions occur for causing the electron beam 71, 72, 73 to converge on the screen. An alternative for causing the three beams 71, 72, 73 to converge on the screen is to direct the outer focusing structures 9 and 11 slightly inwards in combination with the oblique incidence of the outer beams produced by the beam-shaping part 7.

Figure 5A:
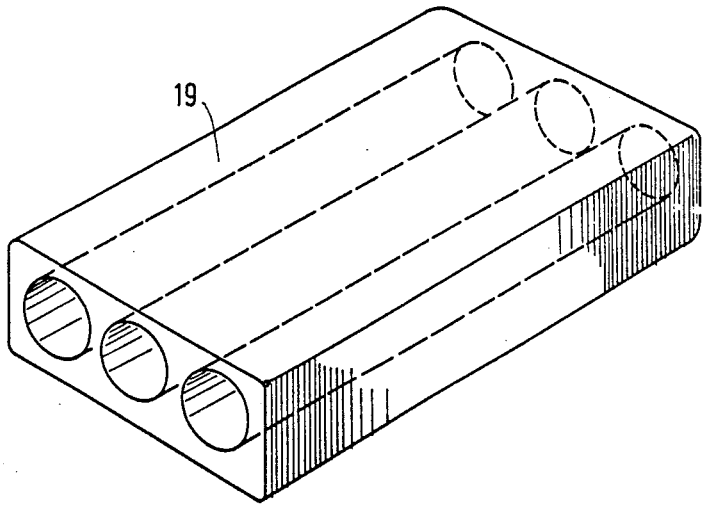
FIGS. 5A and 5B show two different arrangements for accommodating components of an electron gun according to the invention.

The focusing structures 9, 10 and 11 may comprise high-ohmic resistive layers which are provided on inner surfaces of hollow cylinders located in one plane, as in FIG. 1, or of cylinders in a delta arrangement. Instead of being provided on the inner surfaces of separate hollow cylinders, the high-ohmic resistive layers may be alternatively provided on the walls of three bores (FIGS. 5A, 5B) provided in one (for example, glass or ceramic) body 19, 20, respectively.

Figure 2:
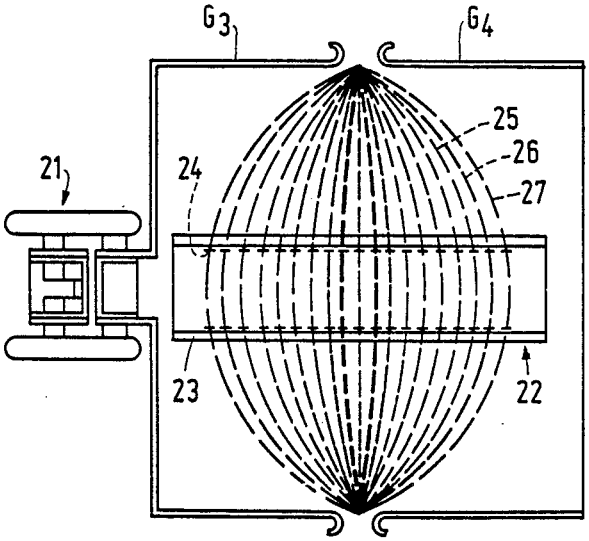
FIG. 2 shows an electron gun with two different focusing lens structures and the equipotential faces of the electric fields generated thereby.

FIG. 2 shows diagrammatically an electron gun comprising a beam-shaping part 21 and a focusing structure 22 having a hollow cylinder 23 with a helical resistive layer 24. This resistive layer 24 may be formed in such a way that, when applying a voltage across this layer, equipontential faces 25, 26, 27, etc. are produced which correspond to the equipontential faces of a conventional focusing lens with focusing electrodes G3, G4. This means that with a gun having a focusing lens formed by a helical resistive layer with a relatively small diameter the same small spherical aberration can be achieved as with a conventional gun having a much larger diameter. In addition to a single-beam gun this is particularly important for a multibeam color gun which may still have a very small spherical aberration in spite of the fact that there is only a limited space available for the three helical structures. It will be explained hereinafter how a non-rotationally symmetrical lens element can be realized when using a high-ohmic resistive layer for a focusing lens.

Figure 3:
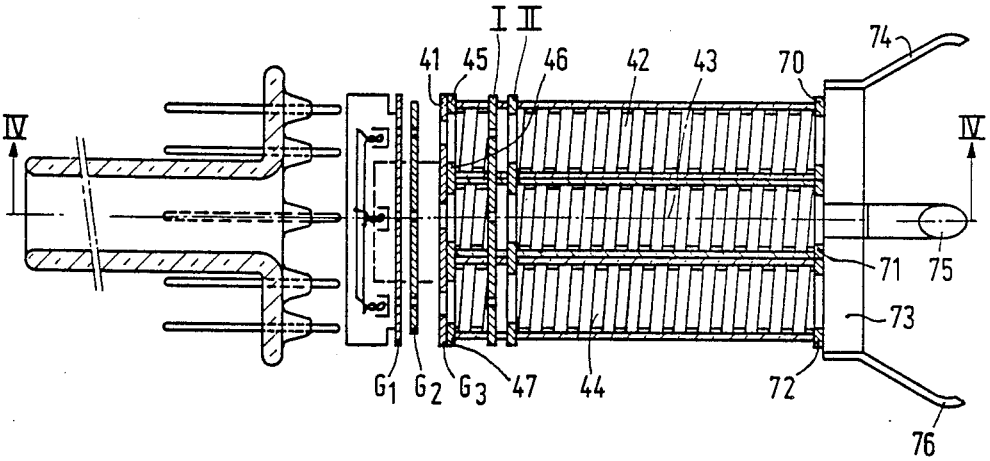
FIG. 3 is a longitudinal section through an electron gun suitable for use in the display tube of FIG. 1.
Figure 4:
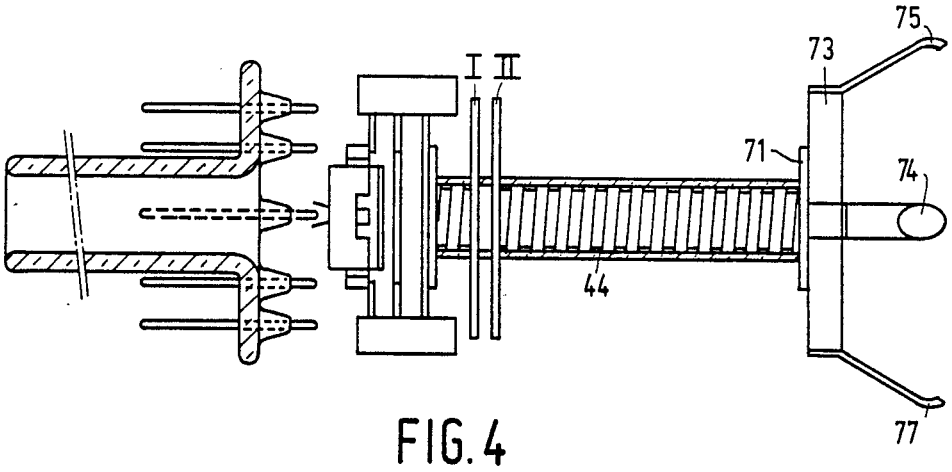
FIG. 4 is a cross-section taken on the line IV—IV of the electron gun of FIG. 3.
Figure 5B:
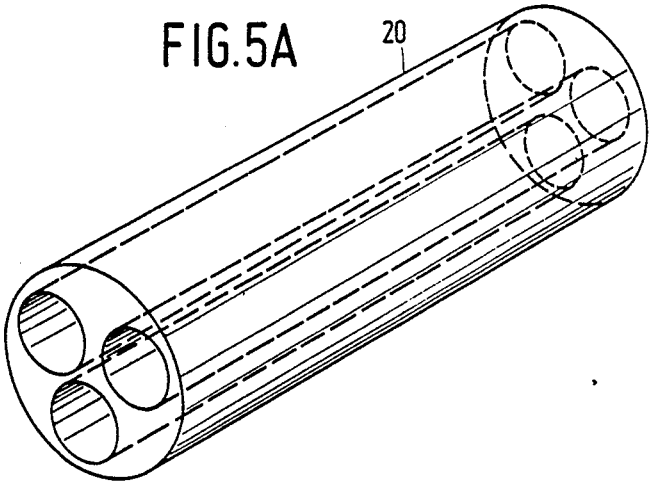

In FIGS. 3 and 4 an electron gun having a three-fold (integrated) beam-shaping part and three individual focusing structures each comprising a hollow cylinder structure with a resistive layer pattern is shown in greater detail. Here the principle of the invention has been used advantageously. Three hollow cylinder structures 42, 43, 44 are secured via flat metal rings 45, 46, 47 at their ends to the last electrode (G3) of the beam-shaping part constituted by a metal plate 41. Instead of three separate metal rings, one metal plate having three apertures may be used alternatively for securing the hollow cylinder structures to the beam-shaping part. At their opposite ends the cylinder structures 42, 43, 44 have flat metal rings 70, 71, 72. These rings are fixedly secured (for example, by means of welding) to a metal palte 73 having centering springs 74, 75, 76, 77. Instead of four centering springs it is alternatively possible to use, for example three or six centering springs. The resistive layers on the inner surfaces of the hollow cylinder structures 42, 43, 44 can be connected in different manners to electric voltage sources via the rings 70, 71, 72. In the case shown in FIGS. 3 and 4 each cylinder structure comprises a first hollow cylinder with a (helical) internal resistive layer pattern constituting a prefocusing lens and second hollow cylinder secured thereto with a (helical) internal resistive layer patten constituting a main focusing lens. In this case securing is affected by providing the three cylinders of the prefocusing lenses with a metal end plate I having three apertures and by providing the three cylinders of the main focusing lenses with a metal end plate II having three aperatures and by securing the end plates I and II to each other. However, the invention is not limited to such a focusing structure arrangement. Neither is it necessary to provide the resistive layer patterns on the inner and/or outer walls of three individual hollow cylinders as is shown in FIGS. 3 and 4. Alternatively, they can be provided on the inner walls of bores provided in one and the same solid body 19 (FIG. 5A) or 20 (FIG. 5B). The bores may have both a single-plane configuration and a delta configuration.

The invention provides the possiblity of using Dynamic and/or Astigmatic Focus corrections. For this purpose non-rotationally symmetrical (astigmatic) lens elements are required in the focusing lens, which elements can be realized in different manners.

Figure 6A:
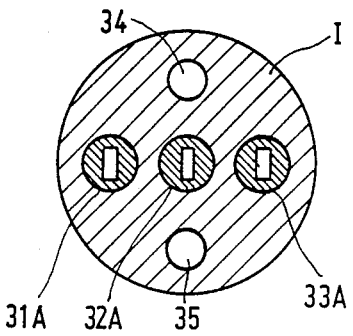
FIGS. 6A and 6B are front elevations of two metal components for forming a non-rotationally symmetrical lens element in the electron gun of FIGS. 3 and 4.
Figure 6B:
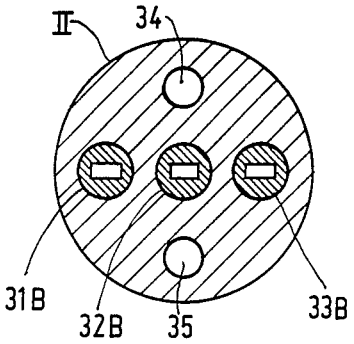

If the focusing structure is formed in two parts, as is shown diagrammatically in FIGS. 3 and 4, non-round holes for forming astigmatic lens elements can be provided, for example in the metal end plates I and II. For a color gun, embodiments of the end plates I and II are shown diagrammatically in FIGS. 6A and 6B. The reference numerals 31A, 32A, 33A indicate the positions on plate I for the 3 beams which have "vertical" rectangular holes and the reference numerals 31B, 32B, 33B indicate the positions on plate II for the 3 beams which have "horizontal" rectangular holes. Holes in the positions 34 and 35 may be use for the necessary alignment and centration. In this case it has been assumed that separate plates A and separate plates B are mounted on the apertured (circular) end plates I and II. FIGS. 6A, 6B only show the principle. Various embodiments are of course possible. The astigmatic elements may be dynamically controlled by applying a dynamically varying voltage to the end plates I and II.

If the prefocusing lens and the main lens for each electron beam are integrated in a single tubular structure provided with an internal high-ohmic resistive layer as in, for example . . . (PHN 11.653), non-rotationally symmetrical lens elements can be formed by giving the (helical) resistive layer a special pattern, as will be further described hereinafter.

Figure 7:
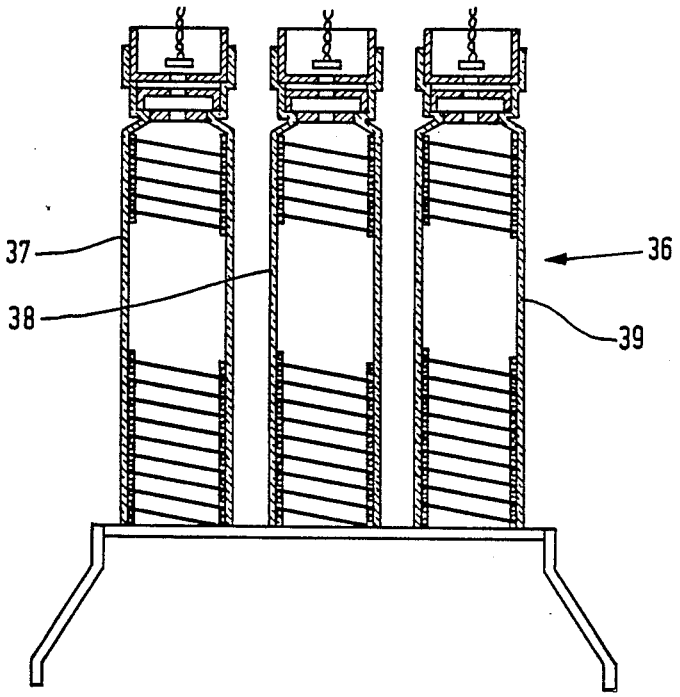
FIG. 7 shows an alternative arrangement for accommodating components of an electron gun according to the invention.

A three-beam gun 36 comprising three individual (glass) tubular structures 37, 38, 39 each comprising both the (plate-shaped) electrodes of the beam-shaping part and the high-ohmic resistive layer pattern for the forcusing structure provided with a non-rotationally symmetrical lens element is shown diagrammatically in FIG. 7. Such structures are sometimes referred to as "glass guns". In addition to a combination of (three) such guns (in a single-plane arrangement or in a triangular arrangement) the invention also relates to single glass guns. In the latter case the high-ohmic resistive layer may be provided either on the inner surface and/or outer surface of a hollow support structure positioned in the neck of the tube, or it may be provided on the inner surface of the neck of the tube itself.

It is possible inter alia to manufacture very stable high-ohmic resistive layers by mixing glass enamel particles with $RuO_2$ or other metal oxides such as Mu and Co and by providing the mixture thus obtained in the form of a layer on the inner side of the hollow structure by means of a suction technique. As compared with a resistive layer on the outer surface, a resistive layer on the inner surface of a hollow structure has the advantage that on problems due to undefined charging of the inner wall can be caused during operation. When firing the tube, the glass enamel melts and a high-ohmic resistive layer on the wall is obtained which is very stable and which does not change during processing of the tube (fusing of the neck, aquadag firing, glass frit seal, exhausting process) and during the so-called sparking process of the tube.

Internal resistive layer elements can be electrically contacted, for example by means of metal strips or wires which are passed through openings in the envelopes of the hollow structures.

The high-ohmic resistive layer operates as a voltage divider. It may be a continuous layer which is provided directly on the wall of the hollow structure (continuous focusing lens). Alternatively, a number of narrow annular electrodes may be provided on the inner wall of the hollow structure. The high-ohmic resistive layer is then provided between or across these electrodes. This (ring) lens yields concentrically homogeneous fields.

A preferred embodiment is formed by providing a helical interruption (for example, by means of a laser or a chisel) in a resistive layer prior to firing, so that a resistive layer can be used which is less high-ohmic than that in the two previously mentioned alternatives ("helical" lens).

If a high-ohmic resistive layer 41 on a wall of a cylinder 40 (FIG. 8) is provided with a helical groove 42 bisecting the layer and having a constant pitch, a rotationally symmetrical electric field is generated when a voltage difference is applied to the ends of the remaining resistive layer pattern.

Figure 8:
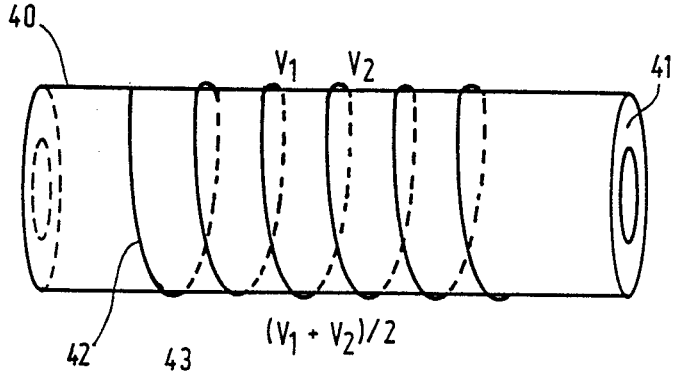
FIG. 8 shows a resistive layer pattern on a hollow cylinder for forming a rotationally symmetrical lens element.
Figure 9:
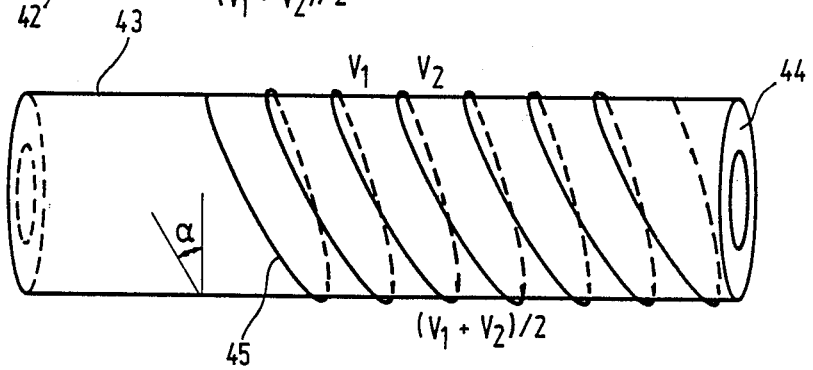
FIGS. 9–11 show different resistive layer patterns on hollow cylinders for forming non-rotationally symmetrical lens elements.

For the sake of clarity the layer 41 in FIG. 8 (and) subsequent Figures) is shown on the outer wall. However, in practice it is preferred—for reasons mentioned hereinbefore—to provide the resistive layer on the inner wall of the cylinder. This is a result of the fact that the z positions of the resistive strips on the upper side of the helix are located halfway the z positions of the strips on the lower side of the helix. See FIG. 8 where the groove parts on the front side of a cylinder 40 are denoted by a solid line and those on the rear side are denoted by a broken line. If the voltages at two successive (top) strips on the upper side are denoted by $V_1$ and $V_2$, the voltage at the (bottom) strip on the front side is $(V_1+V_2)/2$. This voltage is identical to the voltage of en element, halfway the strips on the upper side, with the same z position as the strip on the lower side. This means that at least in a first approximation no dipole field is generated. FIG. 9 shows a high-ohmic resistive layer 44 provided on a wall of a cylinder 43 and having a helical groove 45 such that the bottom strips are not positioned halfway the top strips. In this case a dipole field is generated. This dipole field is the stronger as the angle of inclination $\alpha$ is larger. Dependent on the desired effect a static voltage or a dynamically varying voltage can be applied across the dipole lens element thus obtained. For example, a dynamic convergence effect can be achieved when using such a dynamically varied dipole in the outer focusing structures of a color gun.

Figure 10:
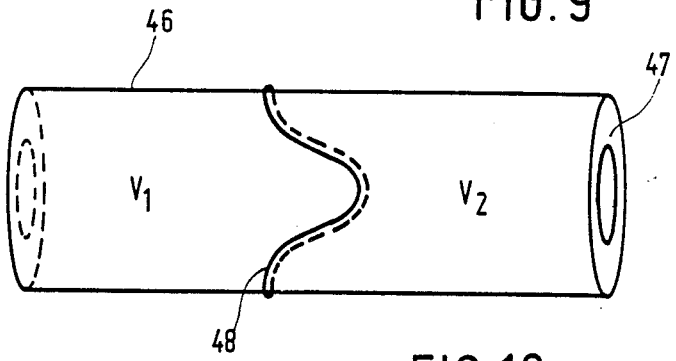
Figure 11:
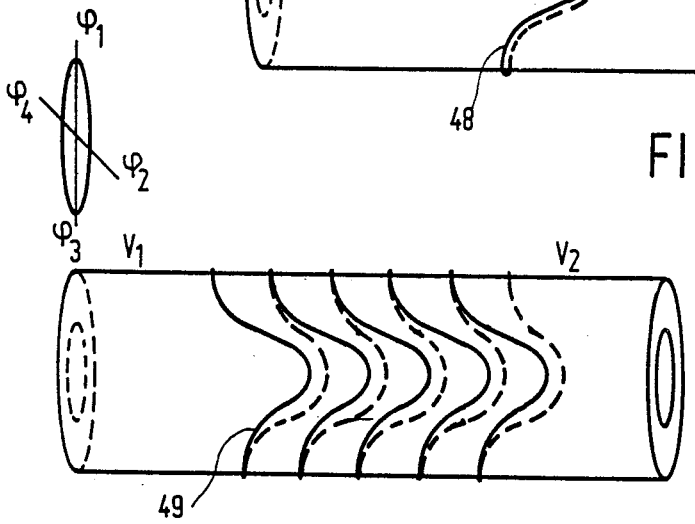

Another form of a non-rotationally symmetrical lens element is a four-pole element. FIG. 10 shows a high-ohmic resistive layer 17 provided on a wall of a cylinder and having a groove 48 (which is continuous). This groove has an oscillating shape with two recurrences. If different voltages are applied to the resistive layer 47 on either side of the groove, an electric four-pole field is generated. An electric four-pole field can also be generated in the case of FIG. 11 where a groove 49 (discontinuous) with the basic shape of the groove of FIG. 10 is recurrent. Resistive layers having groove structures as shown in FIGS. 8 to 11 can easily be incorporated in a helical lens for providing a non-rotationally symmetrical electron-optical lens element. This is not limited to two-poles and four-poles. By suitable variation of the groove structure (as a function of the azimuth angle $\phi$) the resistance per turn can be varied in a desired manner so that electric multipoles of any order can be realized.

We claim:

1. A display tube having an envelope, comprising a phosphor screen on one side and a neck portion on the other side, and an electron gun positioned in the neck portion and comprising a beam-shaping part for producing an electron beam, and a focusing structure for focusing the produced electron beam on the phosphor screen, characterized in that the focusing structure comprises an elongate hollow structure having an inner surface and an outer surface and having a high-ohmic layer of resistive material provided on at least one of said surfaces, which layer operates as a voltage divider, and in that electric means are provided to form a non-rotationally symmetrical lens element in the area of the focusing structure.

2. A color television display tube as claimed on claim 1, characterized in that the elongate hollow structure comprises two coaxially arranged structure parts with a high-ohmic layer of resistive material provided on the inner surface, the facing ends of the structure parts each being provided with an apertured metal plate and the shape of the apertures in the metal plates being adapted to provide a non-rotationally symmetrical lens element.

3. A display tube as claimed in claim 1, characterized in that a part of the high-ohmic resistive layer of the focusing structure is adapted to form a non-rotationally symmetrical lens element.

4. A display tube as claimed in claim 3, characterized in that the part of the resistive layer has a groove pattern in the form of a helix bisecting the layer, the pitch of the helix varying as a function of the azimuth angle to form a desired non-rotationally symmetrical lens element.

5. A color television display tube having an envelope, comprising a phosphor screen on one side and a neck portion on the other side, and an electron gun positioned in the neck portion and comprising a beam-shaping part for producing three electron beams, and three individual focusing structures for focusing the produced electron beams on the phosphor screen, characterized in that each focusing structure comprises an elongate hollow structure having an inner surface and an outer surface and having a high-ohmic layer of resistive material provided on at least one of said surfaces, said layer operating as a voltage divider, and in that electric means are provided to form a non-rotationally symmetrical lens element in the area of each focusing structure.

6. A color television display tube as claimed in claim 5, characterized in that each elongate hollow structure comprises two coaxially arranged structure parts with a high-ohmic layer of resistive material provided on the inner surface, the facing ends of the structure parts each being provided with an apertured metal plate and the shape of the apertures in the metal plates being adapted to provide a non-rotationally symmetrical lens element.

7. A color television display tube as claimed in claim 1, characterized in that a part of the high-ohmic resistive layer of the focusing structure is adapted to form a non-rotationally symmetrical lens element.

8. A color television display tube as claimed in claim 7, characterized in that the part of the resistive layer has a groove pattern in the form of a helix bisecting the layer, the pitch of the helix varying as a function of the azimuth angle to form a desired non-rotationally symmetrical lens element.

* * * * *